United States Patent [19]

Matsui et al.

[11] Patent Number: 4,588,220

[45] Date of Patent: May 13, 1986

[54] STRUCTURE FOR REMOVABLY MOUNTING SUPPORT ROD FOR OPENABLE CLOSURE MEMBER OF MOTOR VEHICLE

[75] Inventors: Tatsuhiko Matsui, Zama; Hiroyuki Aida, Hatano; Akira Watanabe, Mouka; Miyoshi Masakazu, Yokohama, all of Japan

[73] Assignees: Nissan Motor Company, Limited; Kato Hatsujo Kaisha, Ltd., both of Yokohama, Japan

[21] Appl. No.: 539,179

[22] Filed: Oct. 5, 1983

[30] Foreign Application Priority Data

Oct. 6, 1982 [JP] Japan ..... 57-175948

[51] Int. Cl.[4] ..... E05C 17/14

[52] U.S. Cl. ..... 292/338; 292/262

[58] Field of Search ..... 292/338, 339, 262, 268, 292/269, 270, 288, 340, DIG. 38; 248/351, 357; 297/377; 217/60 B, 60 C, 60 D

[56] References Cited

U.S. PATENT DOCUMENTS

| | | | |
|---|---|---|---|
| 1,303,441 | 5/1919 | Wilton | 217/60 C |
| 1,352,602 | 9/1920 | Herzog | 217/60 D |
| 2,090,473 | 8/1937 | Crabb | 217/60 C |
| 2,252,653 | 8/1941 | Thomas | 217/60 D |
| 2,833,583 | 5/1958 | Stone et al. | 292/340 |
| 3,225,856 | 12/1965 | Caramanna | 292/262 X |
| 4,259,811 | 4/1981 | Davis | 292/268 X |

FOREIGN PATENT DOCUMENTS

| | | | |
|---|---|---|---|
| 2363107 | 6/1975 | Fed. Rep. of Germany | 292/262 |
| 2418061 | 10/1975 | Fed. Rep. of Germany | 292/262 |
| 23 | of 1875 | United Kingdom | 292/262 |
| 320493 | 10/1929 | United Kingdom | 217/60 C |

*Primary Examiner*—Robert L. Wolfe
*Assistant Examiner*—Russell W. Illich
*Attorney, Agent, or Firm*—Schwartz, Jeffery, Schwaab, Mack, Blumenthal & Evans

[57] ABSTRACT

In a structure for removably mounting a support rod for an openable closure member such as engine hood, trunk lid or the like of a motor vehicle, a retainer member of a plastic material is mounted on at least one end of the support rod, and an anchor member of a plastic material which is adapted for engagement with the retainer member, is mounted in a mounting aperture formed either in the vehicle's body or the openable closure member. By virtue of the engagement between the retainer member and the anchor member, the support rod is removably retained with respect to either the vehicle's body or the openable closure member, thereby supporting the openable closure member at its open position.

2 Claims, 8 Drawing Figures

STRUCTURE FOR REMOVABLY MOUNTING SUPPORT ROD FOR OPENABLE CLOSURE MEMBER OF MOTOR VEHICLE

BACKGROUND OF THE INVENTION

1. Field of the Invention

This invention relates to a structure for removably mounting a support rod for supporting, in an open position, an openable closure member such as hood, trunk lid or the like which is pivotally mounted to open and close the engine room, trunk room or the like of a motor vehicle.

2. Description of the Prior Art

In order to have a better understanding of the present invention, reference will first be made to FIGS. 1A, 1B and 1C of the accompanying drawings, which illustrate an example of the prior-art structure using a support rod 1 such as shown in FIG. 1A, the prior-art structure being shown as applied to the engine hood of a motor vehicle. In the illustrated conventional structure, the support rod 1 is constituted by a single metal rod-like body having the opposite ends thereof worked to be bent in a hook-like shape and in a crank-like shape as indicated at 1*a* and 1*b* respectively. In actual use of the support rod 1, the crank-shaped end 1*a* is disposed in engagement with a mounting aperture formed in a bracket provided on the upper margin of a radiator core support panel 4 which defined the front portion of the engine room, as shown in FIG. 1B, while the hook-shaped end 1*b* is detachably anchored at an aperture formed in a reinforcement panel 3 attached to the inner surface of the hood panel, as shown in FIG. 1C, thereby supporting the hood at its open position as desired.

However, the aforementioned prior-art structure is disadvantageous in that difficulties are experienced in an attempt to mount the end 1*b* of the support rod 1 in the aperture formed in the reinforcement panel 3 for the hood, due to the fact that the end portion 1*b* is configured in hook-like or C-like shape, as mentioned above, for the purpose of preventing the hood, which is supported in its open position by means of the support rod, from being removed from the support rod when the hood is blown by a gust. Another disadvantage of the prior-art structure is such that since the hook-like end portion 1*b* is brought into direct engagement with the mounting aperture of the reinforcement panel 3, it is very likely that when the mounting operation is carried out, the panel surface is scratched by the fore end 1*b* of the support rod 1 so that scars are left there which result in the formation of rust.

SUMMARY OF THE INVENTION

Accordingly, it is an object of the present invention to provide a novel and improved structure for removably mounting a support rod for an openable closure member such as engine hood, trunk lid or the like of a motor vehicle, thereby eliminating the aforementioned disadvantages of the prior art.

Briefly stated, according to the present invention, a retainer member of a plastic material formed with an engagement aperture and a guide passage communicating therewith is provided on one or both of the ends of the support rod; an anchor member of a plastic material, which is adapted for engagement with the retainer member, is provided either on the vehicle's body or the openable closure member; and by virtue of the engagement between the retainer member and the anchor member, the support rod is detachably retained, at one end thereof, with respect to either the vehicle body or the openable closure member.

Other objects, features and advantages of the present invention will become apparent from the ensuing description taken in conjunction with the accompanying drawings.

DESCRIPTION OF THE PREFERRED EMBODIMENTS

Figure 1A:
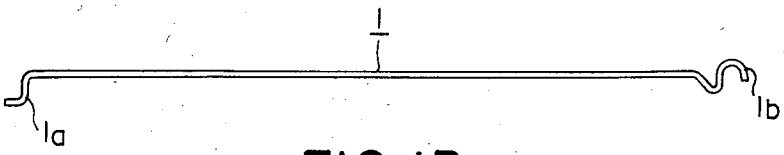
FIG. 1A PRIOR ART
FIG. 1A is a plan view illustrating the entire configuration of a conventional support rod made of metal.
Figure 1B:
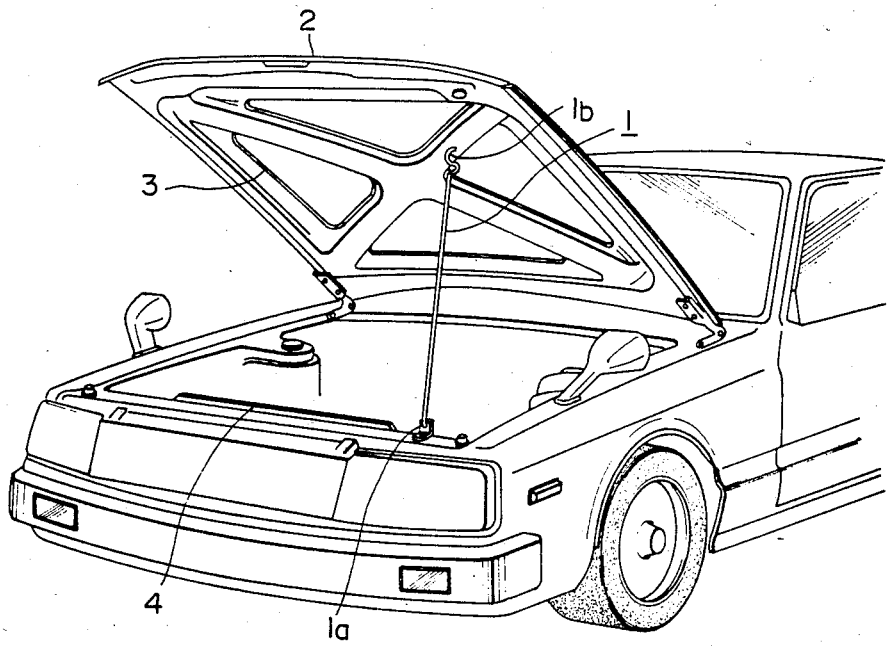
FIG. 1B PRIOR ART
FIG. 1B is a fragmentary perspective view of a motor vehicle, showing the engine hood thereof as being supported at its open position by means of the support rod.
Figure 1C:
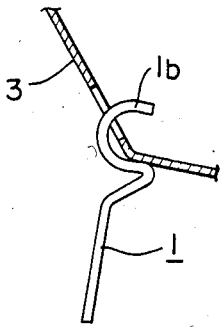
FIG. 1C PRIOR ART
FIG. 1C is an enlarged sectional view illustrating the support rod as being retained with respect to the engine hood.
Figure 2A:
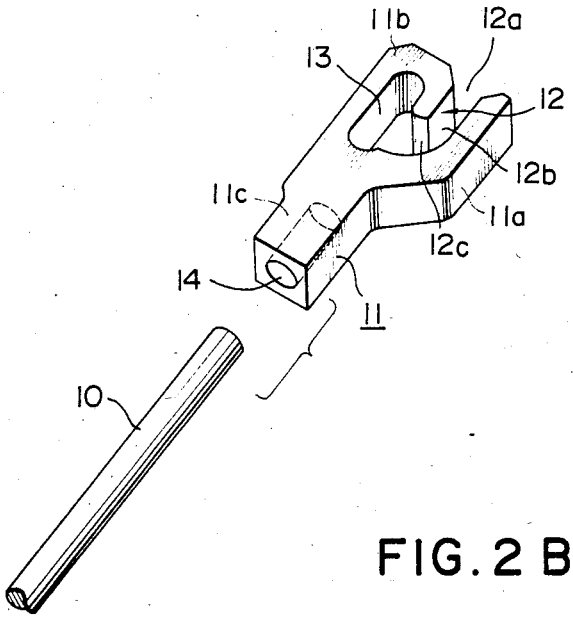
FIG. 2A is an exploded perspective view showing a support rod and a retainer member to be attached thereto, which are usable with the structure according to the present invention.
Figure 2B:
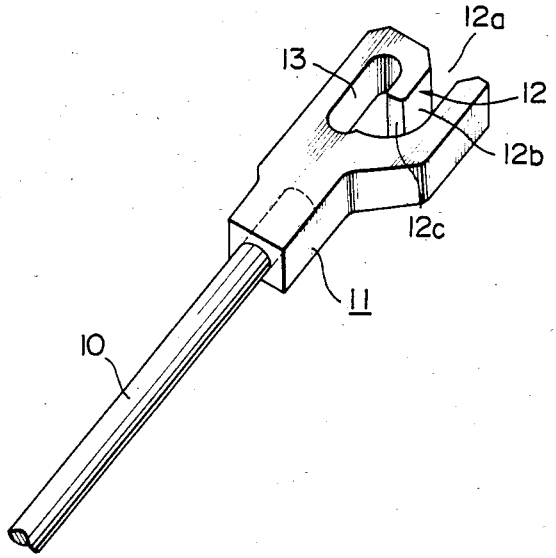
FIG. 2B is a perspective view showing the retainer member as being attached to one end of the support rod.
Figure 3A:
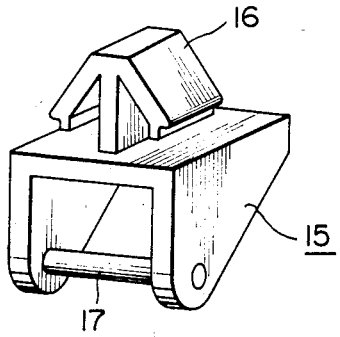
FIG. 3A is a perspective view showing an anchor member usable with the structure according to the present invention.
Figure 3B:
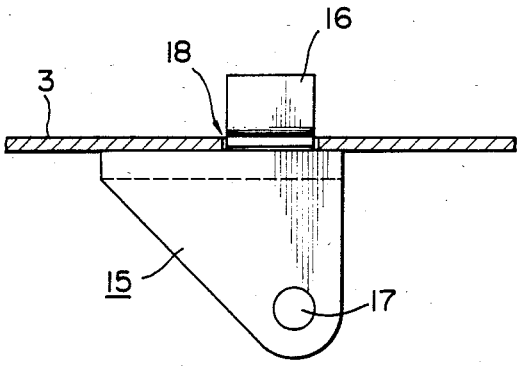
FIG. 3B is a sectional view showing the anchor member as being attached to the engine hood of a motor vehicle.
Figure 4:
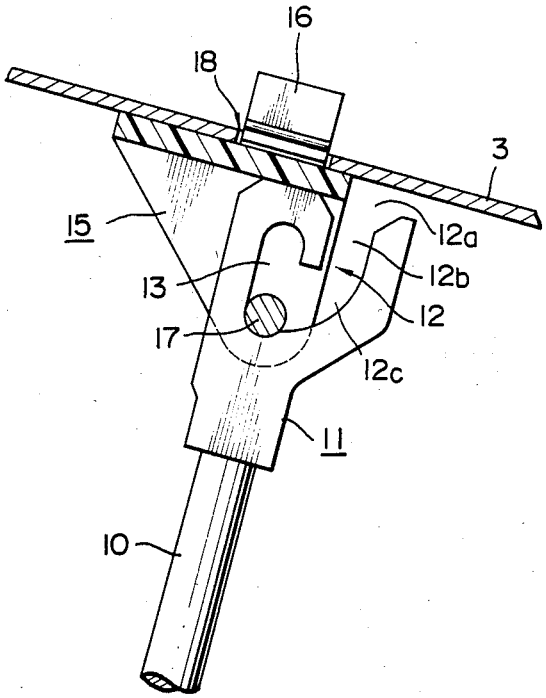
FIG. 4 is a sectional view showing the major portion of the structure according to the present invention.

Referring to FIGS. 2 to 4, there is shown the structure according to an embodiment of the present invention, wherein use is made of a support rod which is constituted by a substantially straight rod-like body of a plastic material, preferably a glass-fiber-reinforced plastic material, such as shown in FIG. 2A, and a retainer member 11 molded of a plastic material is mounted onto the fore end portion of the support rod 10, the retainer member being adapted for engagement with an anchor member which will be described hereinafter.

As will be seen in FIG. 2A, the retainer member 11 comprises a thumb-like portion 11*a* a hook-like portion 11*b* configured in an inverted U-shape, and a shank portion 11*c* which is integral with the portions 11*a* and 11*b*. In the retainer member 11, a guide passage 12 is defined between the thumb-like portion 11*a* and the hook-like portion 11*b;* an engagement aperture 13 is defined by the hook-like portion 11*b;* and an axial hole 14 is formed in the free end portion of the shank portion 11*c*. The guide passage 12 comprises a tapered entrance portion 12*a* opened at a side of the top portion of the retainer member, a substantially straight portion 12*b* extending from the entrance portion 12*a* in substantially parallel relationship with the support rod 10 when the retainer member 11 is attached to the support rod 10, and an inclined portion 12*c* extending in communication with the straight portion 12*b* and engagement aperture 13. In order to attach the retainer member 11 onto the support rod 10, the latter is inserted, at one end thereof, into the axial hole 14.

Referring to FIG. 3A, the anchor member is shown generally at 15, which comprises a resiliently deformable anchor leg 16 configured in arrowhead-like shape;

and an anchor pin 17 adapted for engagement with the engagement aperture 13 of the retainer member 11. The anchor member 15 is attached to the reinforcement panel 3 mounted on the inner surface of the hood panel, with the anchor leg 16 thereof being disposed in engagement with the mounting aperture 18 formed in the reinforcement panel 3.

With the aforementioned structure of the present invention, when it is attempted to support the hood in its open position by means of the support rod, the anchor pin 17 of the anchor member 15, which has been mounted in the mounting aperture 18 of the panel 3, is simply brought into engagement with the engagement aperture 13 of the retainer member 11 mounted on the end of the support rod 10, through the guide passage 12 comprising the entrance portion 12*a*, straight portion 12*b* and inclined portion 12*c*, so that the end of the support rod 10 is engaged with the anchor member 15. It is to be particularly noted that even if the hood is blown by a gust, it is possible to prevent the anchor member 15 and retainer member 13 from being accidentally disengaged from each other, by virtue of the fact that the engagement between the anchor pin 17 of the anchor member 15 and the engagement aperture 13 of the retainer member 11 is effected through the guide passage 12 which meets the engagement aperture 13 at one side thereof.

Although it goes without saying that the foregoing structure of the present invention can be applied to the both ends of the support rod 10, it is possible that the present structure may be applied to one of the vehicle body-side and closure member-side ends of the support rod and that a retainer member which is different in construction from the above-described one, may be mounted on the other end of the support rod. It is also possible that an anchor member which is different in construction from the above-described one, may be mounted on the other end of the support rod. It is also possible that an anchor member which is different in construction from the aforementioned one may be mounted in the mounting aperture. Alternatively, it is possible that said other end of the support rod may be worked to be bent in a crank-like shape as in the prior art, and in such a case, the bent end may be engaged with a mounting aperture formed in a bracket provided on the panel.

Although in the foregoing embodiment, the support rod was made of a plastic material, it is possible that the support rod may be made of metal as in the prior art.

As mentioned above, according to the present invention, there is provided a structure wherein a retainer member made of a plastic material is provided on one or both or the ends of a support rod, the retainer member being provided with an engagement aperture and a guide passage meeting the engagement aperture at one side thereof, and an anchor member is mounted either on the body of a motor vehicle or the openable closure member thereof, the anchor member and retainer member being adapted for engagement with each other, thereby enabling the openable closure member to be supported at its open position by means of the support rod. As will be appreciated from the above discussion, with the present structure, it is possible to eliminate the necessity for the end or ends of the support rod to be subjected to bending work which requires a complex process and high accuracy as is the case with the prior art. Furthermore, the possibility is also precluded that when the support rod is attached or detached, the panel surface is scratched so that scars are left there which result in the formation of rust as is the case with the conventional structure. Another important advantage of the present invention is such that the possibility is precluded that the support rod is accidentally removed under the influence of an external force. More specifically, when the hood is blown by a gust, the support rod tends to fall clockwise as viewed in FIG. 4, for example, and as a result, the retainer member will be pressed, at the side remote from the thumb-like portion, against the anchor pin and finally have the top recess of the hook-like portion thereof disposed in engagement with the anchor pin so that accidental removal of the retainer member, or the support rod from the anchor member can most effectively be prevented.

Obviously, a plastic support rod is advantageous in that it is never heated, by the engine heat or the like, to such an elevated temperature that inconvenience is experienced in handling as is the case with a metal support rod.

While the present invention has been illustrated and described with respect to specific embodiments thereof, it is to be understood that the invention is by no means limited thereto but encompasses all changes and modifications which will become possible from the appended claims.

What is claimed is:

1. A structure for removably mounting a support rod for an openable closure member of a motor vehicle, comprising:

a support rod adapted, when mounted in position, to support the openable closure member at its open position;

a retainer member of a plastic material comprising a hook-like portion defining an engagement aperture, a thumb-like portion defining with said hook-like portion a guide passage the terminal end of which is in communication with said engagement aperture at one side thereof, and a shank portion integral with said hook-like portion and said thumb-like portion, said shank portion disposed at one end of the retainer member and said thumb-like portion disposed at the opposite end of said retainer member, said one end of said retainer member mounted onto one end of said support rod;

an anchor member comprising a first portion adapted to be anchored at a mounting aperture formed in one of the vehicle's body and the openable closure member, and a second portion adapted to be disposed in engagement with said engagement aperture of said retainer member through said guide passage, wherein said support rod is removably retained with respect to one of the vehicle's body and the openable closure member by virtue of the engagement between said retainer member and said anchor member;

said guide passage of said retainer member comprising a tapered entrance portion opened at one side of a top end of said retainer member, a substantially straight portion extending in substantially parallel relationship with the retainer member which is disposed in alignment with said support rod when said retainer member is mounted onto said support rod, and an inclined portion extending in communication with said substantially straight portion toward a center of said retainer member;

said engagement aperture of said retainer member being formed in such a manner as to extend along said retainer member and communicate, at one side thereof, with said inclined portion of said guide passage;

said first portion of said anchor member comprising an arrowhead-like leg adapted, when inserted in said mounting aperture, to be engaged with the opposite margins of said mounting aperture at the opposite sides thereof;

said second portion of said anchor member comprising a pin fixedly attached to opposite side walls of said anchor member in such a manner as to extend laterally of said anchor member.

2. A structure according to claim 1, wherein said support rod is formed of a plastic material.

* * * * *